US006735322B1

(12) United States Patent
Watanabe

(10) Patent No.: US 6,735,322 B1
(45) Date of Patent: May 11, 2004

(54) SPEAKER

(75) Inventor: Shigeru Watanabe, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 147 days.

(21) Appl. No.: 09/659,454

(22) Filed: Sep. 11, 2000

(30) Foreign Application Priority Data

Sep. 14, 1999 (JP) ..... 11-260560

(51) Int. Cl.[7] ..... H04R 25/00
(52) U.S. Cl. ..... 381/401; 381/420; 381/404
(58) Field of Search ..... 381/396, 398, 381/400, 401, 403, 412, 420, 421, FOR 152, FOR 153, FOR 154, FOR 155, 402, 404, 414, 422

(56) References Cited

U.S. PATENT DOCUMENTS

| | | | | | |
|---|---|---|---|---|---|
| 2,781,461 | A | * | 2/1957 | Booth | 310/27 |
| 3,013,189 | A | * | 12/1961 | Bernier | 335/231 |
| 3,014,996 | A | * | 12/1961 | Swanson | 381/404 |
| 3,032,615 | A | * | 5/1962 | Hamson | 381/409 |
| 3,112,375 | A | * | 11/1963 | Montagu | 335/231 |
| 4,239,943 | A | * | 12/1980 | Czerwinski | 381/404 |
| 4,376,233 | A | * | 3/1983 | Kamon et al. | 381/409 |
| 4,586,192 | A | * | 4/1986 | Arntson | 381/303 |
| 4,609,784 | A | * | 9/1986 | Miller | 381/401 |
| 4,783,824 | A | * | 11/1988 | Kobayashi | 381/402 |
| 5,091,958 | A | * | 2/1992 | Sakamoto et al. | 381/150 |
| 5,249,236 | A | * | 9/1993 | Sakamoto | 381/409 |
| 5,604,815 | A | * | 2/1997 | Paddock | 381/396 |
| 5,668,886 | A | * | 9/1997 | Sakamoto et al. | 381/412 |
| 5,715,324 | A | * | 2/1998 | Tanabe et al. | 381/412 |
| 5,740,265 | A | * | 4/1998 | Shirakawa | 381/412 |
| 5,757,945 | A | * | 5/1998 | Sakamoto | 381/400 |
| 5,828,767 | A | * | 10/1998 | Button | 381/401 |
| 5,850,462 | A | * | 12/1998 | Sakamoto et al. | 381/405 |
| 5,909,499 | A | * | 6/1999 | Tanabe | 381/419 |
| 6,173,065 | B1 | * | 1/2001 | Lin | 381/398 |
| 6,269,167 | B1 | * | 7/2001 | Mango et al. | 381/410 |
| 6,385,328 | B1 | * | 5/2002 | Yoo et al. | 381/412 |

FOREIGN PATENT DOCUMENTS

| | | | | |
|---|---|---|---|---|
| DE | 492142 | * | 7/1992 | 381/412 |
| DE | 492142 A2 | * | 7/1992 | 381/412 |
| FR | 2559-332 A | * | 8/1985 | |
| JP | 55-37066 A | * | 3/1980 | 381/401 |
| JP | 6-100900 A | * | 4/1985 | |

* cited by examiner

*Primary Examiner*—Curtis Kuntz
*Assistant Examiner*—P. Dabney
(74) *Attorney, Agent, or Firm*—Sughrue Mion, PLLC

(57) ABSTRACT

In a speaker, a magnet 23 is disposed at a mid position of a voice coil bobbin 25 mounted on a cone 34. A couple of voice coils 28 and 29 are put around the circumferential outer surface of the voice coil bobbin 25 at the positions thereof facing one end and the other end of the magnet 23. A magnet 32 is disposed within the voice coil bobbin 25, and develops two magnetic fields in a state that the first and second voice coils 28 and 29 are located between the one and other ends of the first magnet 23. Dampers 26 and 27 support the voice coil bobbin 25 at positions such that the voice coil bobbin 25 is axially vibratory. Those positions are located on both sides of and symmetrical with respect to those portions of the voice coil bobbin 25 which are respectively wound with the voice coils 28 and 29.

7 Claims, 6 Drawing Sheets

SPEAKER

BACKGROUND OF THE INVENTION

The present invention relates to a speaker whose voice coil bobbin is supported by a plurality of dampers.

FIG. 5 is a cross sectional view showing a conventional speaker whose voice coil bobbin is supported by a plurality of dampers. In the speaker 1 shown in FIG. 5, a voice coil bobbin 3 is coaxially disposed within a casing 2. The voice coil bobbin is supported at the fore end (the upper end in the drawing) and at the mid position by a couple of dampers 4A and 4B such that the voice coil bobbin 3 is vibratory in the axial direction. Those dampers are located between the voice coil bobbin and the casing 2.

A voice coil 5 is put on the rear end (the lower end in the drawing) of the voice coil bobbin 3. A disc-like plate 6 is made of iron and has a center hole.

The plate 6 is coaxially disposed around the voice coil 5. A slight gap is present between the plate and the circumferential outer surface of the voice coil 5. The plate 6 is fastened to the casing 2.

A magnet 7 having a center hole is bonded to the rear side surface (the lower side surface in the drawing) of the disc-like plate 6 in a state that the magnet 7 and the disc-like plate 6 are coaxially disposed. A disc-like yoke 8 made of iron is bonded to the rear side surface of the magnet 7. A center pole 8A is integrally formed at the central part of the front side surface (the upper side in the drawing) of the disc-like yoke 8. The center pole 8A is inserted into the voice coil bobbin 3 from its rear end, and located therewithin in a state that the former is slidable relative to the latter.

This conventional speaker is arranged such that the voice coil bobbin 3 is supported by use of the two dampers 4A and 4B so as to hold a linearity of a vibration of the voice coil bobbin 3 when it axially vibrates by current of an acoustic reproducing signal flowing through the voice coil 5 in a magnetic field, which is developed, by the magnet 7, among the disc-like plate 6, disc-like yoke 8 and center pole 8A.

The conventional speaker 1 fails to perfectly hold the linearity of the vibration of the voice coil bobbin 3, however. The reason for this is as follows: The dampers 4A and 4B are located closer to the fore end of the voice coil bobbin 3 with respect to the magnetic circuit formed by the voice coil 5, disc-like plate 6 and center pole 8A. Therefore, the supporting positions of the voice coil bobbin 3 are disposed asymmetrically with respect to the magnetic circuit.

Therefore, when the voice coil bobbin 3 vibrates at a low resonance frequency f0 and its vibration amplitude increases, the voice coil bobbin 3 rolls or unintentionally moves. In this state, there is a danger that the voice coil 5 comes in contact with the disc-like plate 6. Particularly in the speaker for reproducing low frequencies, operation of the speaker for reproducing sounds at large output power levels is difficult.

In the structure of the speaker 1, the iron yoke 8 forming the magnetic circuit develops a magnetic field around the voice coil 5. Therefore, the size of the yoke 8 is large relative to the size of the whole speaker 1. Accordingly, the speaker 1 is heavy.

FIG. 6 is a cross sectional view showing another conventional speaker in which a voice coil bobbin is supported by a plurality of dampers. A speaker 10 of FIG. 6 is of the called inside magnet type, while the speaker 1 of FIG. 5 is of the called outside magnetic type in which the magnet is located outside the voice coil bobbin.

The speaker 10 is constructed such that a magnet 11 is located within a voice coil bobbin 12, and the rear end surface (the lower end surface in the drawing) of the magnet 11 is bonded to a yoke 13. The yoke 13 is formed with a disc-like bottom plate 13A and an outside center plate 13B located outside the magnet 11. The circumferential inner surface of the fore end of the outside center plate 13B is confronted with the circumferential outer surface of an inside center plate 14, which is bonded to the fore end surface (the upper end surface in the drawing) of the magnet 11 in a state that a voice coil 15 is interposed therebetween. In the thus constructed speaker, the voice coil develops a magnetic field.

The voice coil bobbin 12 is supported by a damper 17A and a damper 17B such that it is vibratory in the axial direction. The damper 17A is located between the fore end thereof (the upper end in the drawing) and a casing 16. The damper 17B is located between the rear end (the lower end in the drawing) and the outside center plate 13B.

In the speaker 10, the supporting positions of the dampers 17A and 17B are located symmetrically with respect to the voice coil 15. Therefore, a linearity of the vibration of the voice coil bobbin 12 is more reliably secured.

As seen from the figure, in the structure of the speaker 10, the damper 17B for supporting the rear end of the voice coil bobbin 12 is disposed inside the outside center plate 13B. Therefore, the diameter of the damper 17B is limited by the damper 17B.

For this reason, where the outside center plate 13B is small in diameter, the diameter of the damper 17B is correspondingly small. In this case, the vibration characteristic of the voice coil bobbin 12 is impaired. Where the diameter of the outside center plate 13B is excessively increased to increase the diameter of the damper 17B, the speaker 10 increases in size and weight.

SUMMARY OF THE INVENTION

The present invention has been made to solve the problems of the conventional speaker in which the voice coil bobbin is supported by a plurality of dampers. An object of the present invention is to provide a speaker in which the voice coil bobbin is supported by a plurality of dampers, which the speaker can produce sounds at high output power levels, and is reduced in size and weight.

A speaker defined in item 1 comprises: a first magnet disposed at a mid position of a voice coil bobbin while surrounding the circumferential outer surface of the voice coil bobbin mounted on a vibrating plate; a first voice coil wound on the circumferential outer surface of the voice coil bobbin at a position where the voice coil bobbin faces one end of the first magnet with a predetermined gap being interposed therebetween; a second voice coil wound on the circumferential outer surface of the voice coil bobbin at a position where the voice coil bobbin faces the other end of the first magnet with a predetermined gap being interposed therebetween; a center pole, disposed within the voice coil bobbin, for developing two magnetic fields in a state that the first and second voice coils are located between the one and other ends of the first magnet; and at least one couple of dampers for supporting the voice coil bobbin at position's such that the voice coil bobbin is axially vibratory, the positions being located on both sides of and symmetrical with respect to those portions of the voice coil bobbin which are respectively wound with the first and second voice coils.

In the speaker, two magnetic fields are developed between the one end of the other end of the first magnet and the center pole by the first magnet in a state that the first and second voice coils are interposed therebetween.

When current is fed to the first and second voice coils located in those magnetic fields, the voice coil bobbin axially vibrates in accordance with an amplitude of the current.

The voice coil bobbin is supported at least one couple of dampers for supporting the voice coil bobbin at positions which are located on both sides of and symmetrical with respect to those portions of the voice coil bobbin which are respectively wound with the first and second voice coils. Therefore, even when the amplitude of the vibration of the voice coil bobbin is large, a linearity of the vibration is perfectly secured. There is no chance that the voice coil bobbin rolls or unintentionally moves.

A stable vibration of the voice coil bobbin is ensured even when the speaker is a woofer for reproducing low audio frequencies at high power levels. Accordingly, the speaker is capable of reproducing sounds at high fidelity.

The speaker of the invention does not need a large yoke extending to the inside and outside of the voice coil bobbin, which is indispensably used in the conventional speaker. Accordingly, the weight of the speaker is correspondingly reduced. Further, the damper supporting the rear end of the voice coil bobbin is not limited in size by the size of the yoke. Therefore, the size of the damper may be selected to be such a size as not to deteriorate the vibration characteristic of the voice coil bobbin. If the damper size is so selected, the weight of the speaker is not excessively increased.

Thus, the speaker of the item 1 is capable of reproducing sounds at high power levels, although its size is small. For this reason, this speaker is most suitable in particular for a sub-woofer carried on a car, which requires the specification of small size and weight.

A speaker defined in item 2 depends from the item 1. In this speaker, the center pole consists of a second magnet arranged to be opposite in polarity to the first magnet.

The center pole, disposed within the voice coil bobbin, for developing two magnetic fields in a state that the first and second voice coils are located between the one and other ends of the first magnet, is a magnet. Therefore, a large gap flux density is produced in each magnetic field.

Accordingly, the first magnet may be reduced in size by the increase of the gap flux. This leads to size reduction of the speaker. For the same size of the first magnet, the amplitude of the vibration of the voice coil bobbin is increased, and hence the acoustic power is increased.

A speaker defined in item 3 depends from the item 1. In the speaker, the center pole is made of magnetic material.

In the speaker of the item 3, two magnetic fields are formed, by the first magnet, in a state that the first and second voice coils are located between the one end and the other end of the first magnet and the center pole made of magnetic material. When current is fed to the first and second voice coils respectively located in those magnetic fields, the voice coil bobbin vibrates in the axial direction in accordance with an amplitude of the current fed.

A speaker defined in item 4 depends from the item 1. In the speaker, the first and second voice coils are connected in series or in parallel with each other.

In the speaker thus arranged, a current is fed to the first and second voice coils or currents as the result of equally dividing a current in value are fed to those voice coils, respectively. Therefore, the voice coil bobbin is stably vibrated.

To achieve the above object, in the speaker defined in item 5 which depends from the item 1, cotton wires electrically connecting the first and second voice coils are stitched into at least one of the dampers.

A speaker defined in item 5 depends from the item 1. In the speaker, cotton wires electrically connecting the first and second voice coils are stitched into at least one of the dampers. Therefore, there is no chance that tension of the connection cords does not affect the vibration of the voice coil bobbin in any way. Accordingly, a stable vibration of the voice coil bobbin is ensured.

A speaker defined in item 6 depends from the item 1. The speaker further comprises: at least one third magnet is disposed on the front or rear side of the first magnet; and at least one third voice coil wound on the circumferential outer surface of the voice coil bobbin at a location thereof facing the end of the third magnet which is opposite to the end thereof closer to the first magnet, the third voice coil facing the end of the third magnet which is opposite to the end thereof closer to the first magnet in a state that a predetermined gap is present therebetween.

In the speaker of the item 6, the third magnet is provided in addition to the magnets of the speaker of the item 1. Another magnetic field is formed between the third magnet and the center pole or the number of the magnetic fields is increased.

With provision of the third magnet, current is fed to the third voice coil, and the vibration of the voice coil bobbin is increased in amplitude. Accordingly, the acoustic power of the speaker is increased.

DETAILED DESCRIPTION OF THE PREFERRED EMBODIMENTS

The preferred embodiment of the present invention will be described with reference to the accompanying drawings.

Figure 1:
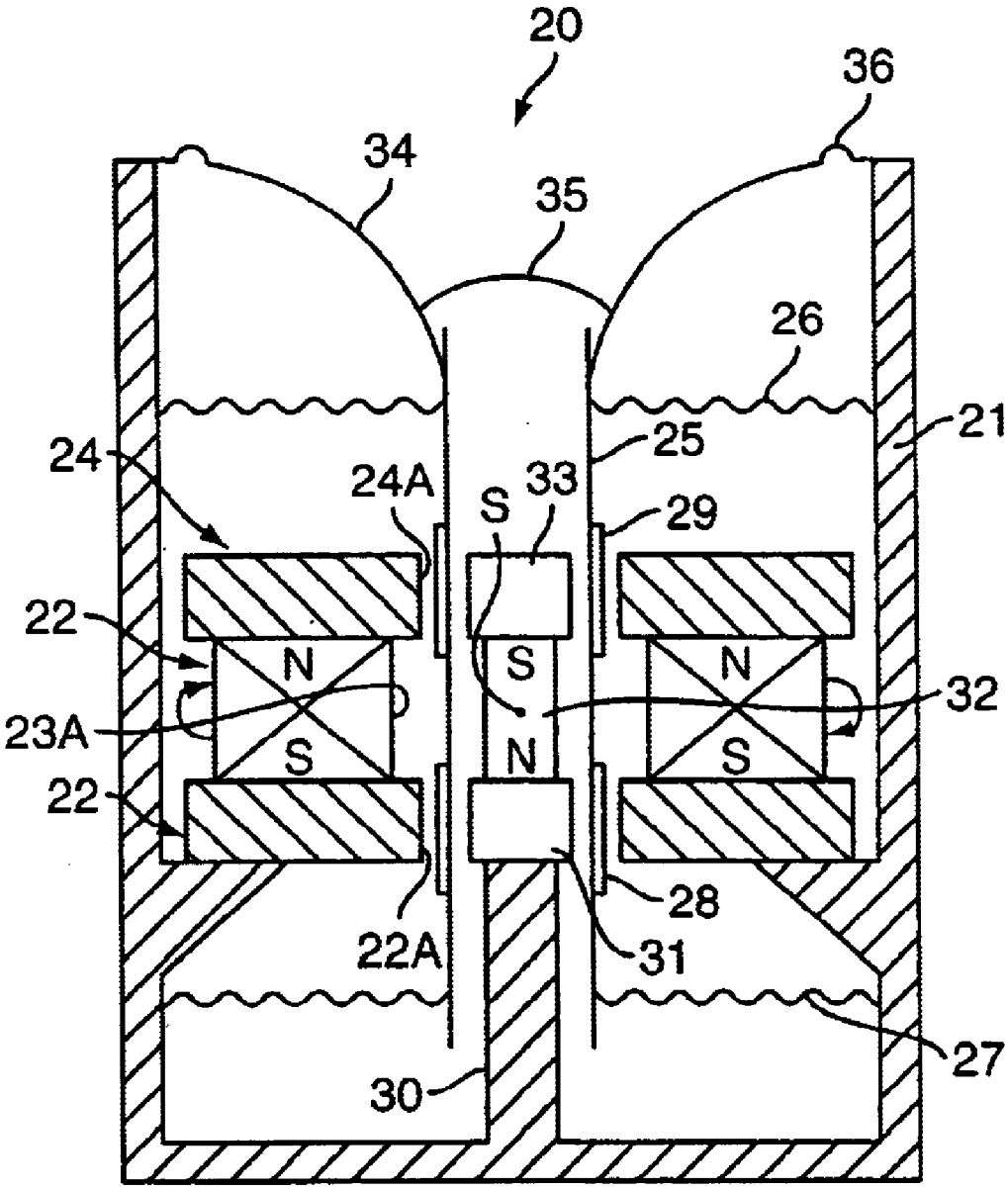
FIG. 1 is a cross sectional view showing an embodiment of a speaker according to the present invention.

FIG. 1 is a cross sectional view showing an embodiment of a speaker according to the present invention.

In FIG. 1, a disk-like lower yoke 22 having a center hole 22A is coaxially disposed within a casing 21 such that it is fastened to the inner wall of the casing 21 of synthetic resin. A cylindrical magnet 23 with a center hole 23A is coaxially disposed within the casing such that it is joined to the front end surface (the upper side surface in the drawing) of the lower yoke 22.

An upper yoke 24, which has the same shape as of the lower yoke 22 and includes a center hole 24A, is coaxially disposed within the casing such that it is put on the front end surface (the upper surface in the drawing) of the cylindrical magnet 23. A through-hole, while being coaxial with the casing 21, is formed by the center holes 22A, 23A and 24A of the lower yoke 22, cylindrical magnet 23 and upper yoke 24. A voice coil bobbin 25 is inserted into the through-hole. The out side diameter of the voice coil bobbin is smaller than the inside diameter of any of the center holes 22A, 23A and 24A of the lower yoke.

The center position "s" of the voice coil bobbin 25 as axially viewed is substantially coincident with the center position of the cylindrical magnet 23 as viewed in the axial direction. The voice coil bobbin 25 is supported by dampers 26 and 27 such that it is vibratory in the axial direction. Those dampers 26 and 27 are inserted between the voice coil bobbin and the casing 21 at positions of the fore end (the upper end in the drawing) and the rear end (the lower end in the drawing) of the voice coil bobbin.

Voice coils 28 and 29 are put around the circumferential outer surface of the voice coil bobbin 25 at the locations thereof, which face respectively the lower yoke 22 and the upper yoke 24. A predetermined gap is formed between the voice coil 28 and the circumferential inner surface of the center hole 22A of the lower yoke 22. A predetermined gap is also formed between the voice coil 28 and the circumferential inner surface of the center hole 24A of the upper yoke 24.

A pole 30 stands erect on the inner wall of the rear end (the lower end in the drawing) of the casing 21, and extends into the voice coil bobbin 25. A lower plate 31, shaped like a disc, is fastened to the fore end (the upper end in the drawing) of the pole 30, so that it is supported at the location facing the circumferential inner surface of the lower yoke 22.

A disc-like magnet 32 is coaxially supported within the voice coil bobbin 25 such that it is joined to the front end surface (the upper end surface in the drawing) of the lower plate 31 and its polarities are opposite to those of the cylindrical magnet 23. Within the voice coil bobbin, a disc-like upper plate 33 is joined to the front end surface (the upper end surface in the drawing) of the magnet 32 and supported at the position facing the circumferential inner surface of the upper yoke 24.

The outside diameter of the voice coil bobbin 25 is smaller than the inside diameter of each of the lower plate 31, magnet 32 and upper plate 33. A predetermined gap is present between the circumferential outer surface of the lower plate 31 and the circumferential inner surface, and a predetermined gap is also present between the circumferential outer surface of the upper plate 33 and the circumferential inner surface of the voice coil bobbin 25. In FIG. 1, reference numeral 34 is a cone-shaped vibrating plate; 35 is a center cap; and 36 is an edge used for supporting the periphery of the vibrating plate 34 on the casing 21.

Figure 2A:
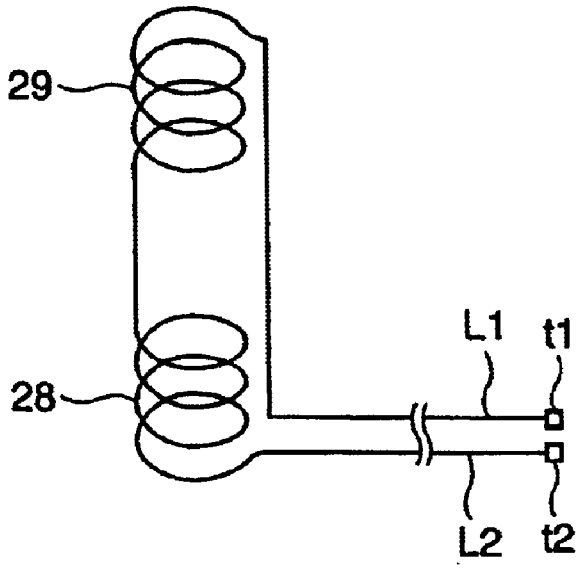
FIGS. 2A and 2B are diagrams showing electrical connections of voice coils available for the FIG. 1 speaker.
Figure 2B:
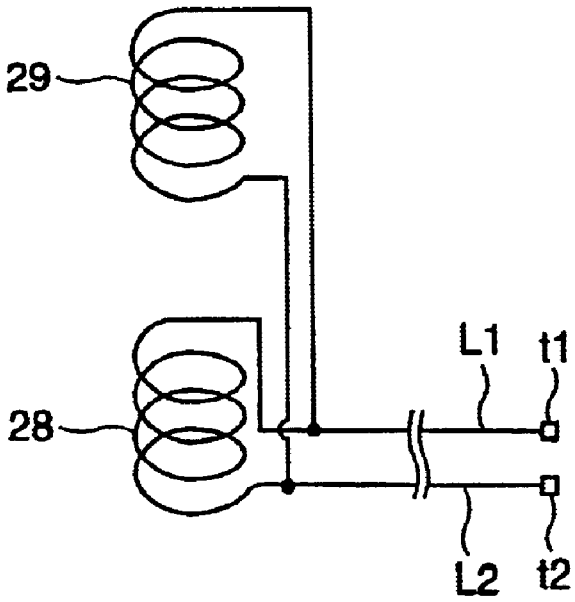
Figure 3:
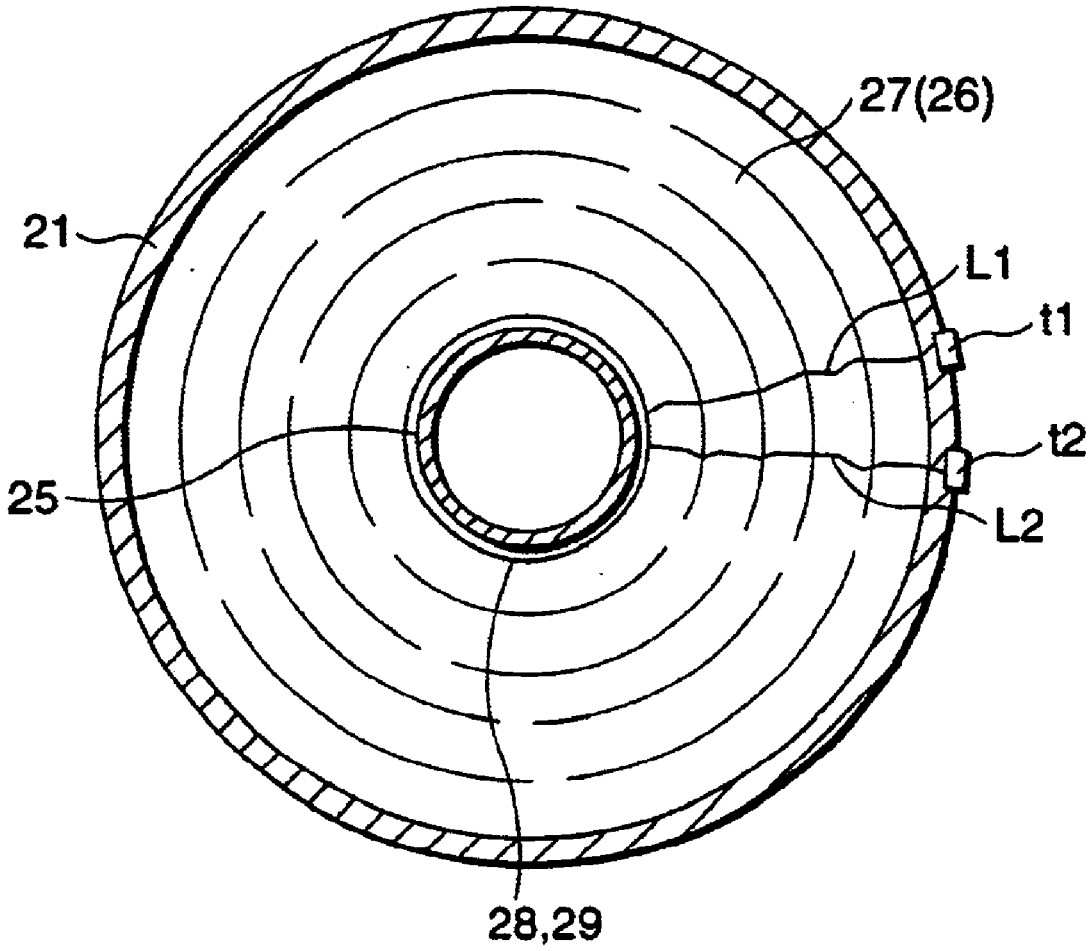
FIG. 3 is a cross sectional view showing how cotton wires are stitched in a damper in the FIG. 1 speaker.

Exemplars of electrical connections of the voice coils 28 and 29 are shown in FIGS. 2 and 3. In the exemplar of FIG. 2A, the voice coils 28 and 29 are connected in series. In the exemplar of FIG. 2B, the voice coils 28 and 29 are connected in parallel. In each of those connections, connection cord s used for connecting the voice coils 28 and 29 are laid on the circumferential outer surface of the voice coil bobbin 25.

In either case, a pair of cotton wires (connection cords) L1 and L2 are stitched into the damper 27 (or 26) as shown in FIG. 3. Those cotton wires L1 and L2 are connected to terminals t1 and t2 provided on the outer wall of the casing 21.

If required, those wires L1 and L2 may be respectively stitched into the dampers 26 and 27.

In the speaker 20 thus constructed, magnetic fields, which are developed by the magnets 23 and 32, are present in the gap between the lower yoke 22 and the lower plate 31 and the gap between the upper yoke 24 and the upper plate 33.

When an acoustic current is fed to the voice coils 28 and 29, which are located in the magnetic fields, by way of the paths including the terminals t1 and t2 and the cotton wires L1 and L2, the voice coil bobbin 25 axially vibrates in accordance with an amplitude of the current fed.

The voice coil bobbin 25 is supported by the couple of the dampers 26 and 27 at the positions, which are located on both sides of and symmetrical with respect to a magnetic circuit. The magnetic circuit is formed by the lower yoke 22, cylindrical magnet 23, upper yoke 24, voice coils 28 and 29, lower plate 31, magnet 32 and the upper plate 33. With this structure, the linearity of a vibration of the voice coil bobbin 25 is perfectly sustained even when the voice coil bobbin 25 vibrates at high amplitudes. Accordingly, the voice coil bobbin 25 vibrates while being free from its rolling and unintentional movement.

A stable vibration of the voice coil bobbin 25 is ensured even when the speaker 20 is a woofer for reproducing low audio frequencies at high power levels. Accordingly, the speaker is capable of reproducing sounds at high fidelity.

In the speaker 20, the cylindrical magnet 23 produces a magnetic field in a state that both ends of the cylindrical magnet 23 are located at two positions on the voice coil bobbin 25 as viewed in the axial direction. Therefore, the speaker does not need a large yoke extending to the inside and outside of the voice coil bobbin, which is indispensably used in the conventional speaker. Accordingly, the weight of the speaker is correspondingly reduced.

Since the speaker 20 does not need the large yoke extending to the inside and outside of the voice coil bobbin, the damper 27 supporting the rear end of the voice coil bobbin 25 is not limited in size by the size of the yoke. Therefore, the damper 27 may be selected to have such a size as not to deteriorate the vibration characteristic of the voice coil bobbin 25. If the damper size is so selected, the weight of the speaker 20 is not excessively increased.

In the speaker 20, another magnet 32 is provided on the inner side of the voice coil bobbin 25, in addition to the cylindrical magnet 23 that is located on the outer side of the voice coil bobbin 25. With the provision of the magnet 32, a large magnetic flux is produced in the gap between the lower yoke 22 and the lower plate 31, and the gap between the upper yoke 24 and the upper plate 33.

Accordingly, the magnet 23 may be reduced in size by the increase of the gap flux. This leads to size reduction of the speaker 20. For the same size of the magnet 23, the amplitude of the vibration of the voice coil bobbin 25 is increased, and hence the acoustic power is increased.

In the speaker 20, the connection cords for feeding an acoustic signal to the voice coils 28 and 29 are stitched into the damper 27 (or 26), the vibration of the voice coil bobbin 25 is not affected by the tension of the connection cords. Accordingly, the voice coil bobbin stably vibrates.

In the embodiment, the portion of the speaker 20 except the lower yoke 22, cylindrical magnet 23, upper yoke 24, lower plate 31, magnet 32 and the upper plate 33 is formed of synthetic resin. This feature contributes to weight reduction of the speaker. In the embodiment, the gap magnetic flux is increased by additionally providing the magnet 32 within the voice coil bobbin 25. If necessary, the magnet 32 may be replaced with a center pole of iron.

Also in this case, a couple of dampers for supporting the voice coil bobbin are located at positions, which are located on both sides of and symmetrical with respect to a magnetic circuit. By using the dampers so disposed, a satisfactory linearity of the vibration of the voice coil bobbin is secured. Further, there is no need of using the large iron yoke extending to the outer side and the inner side of the voice coil bobbin. Accordingly, the size and weight reduction of the speaker is secured.

Figure 4:
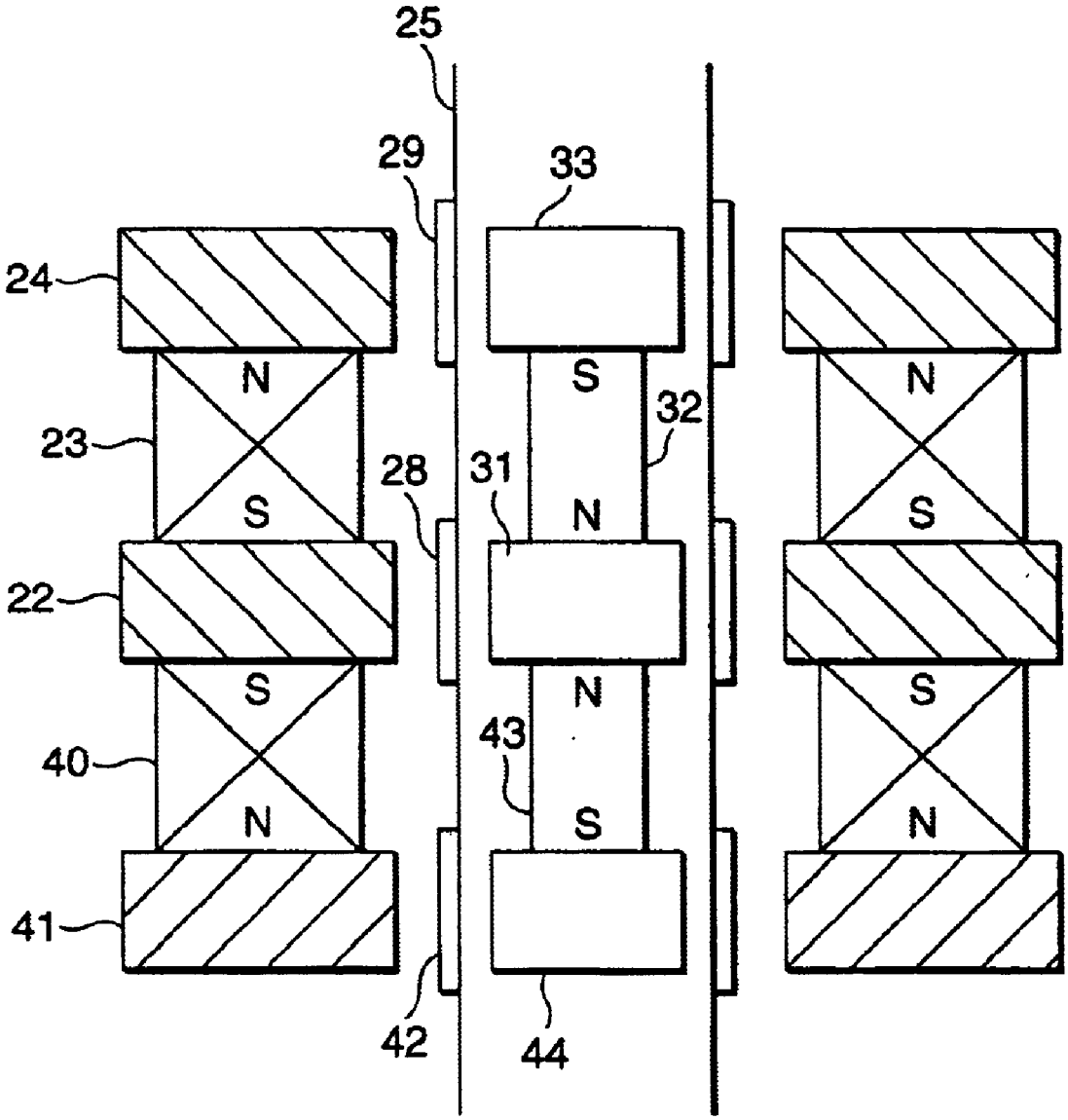
FIG. 4 is a cross sectional view showing a part of a modification of the FIG. 1 embodiment.
Figure 5:
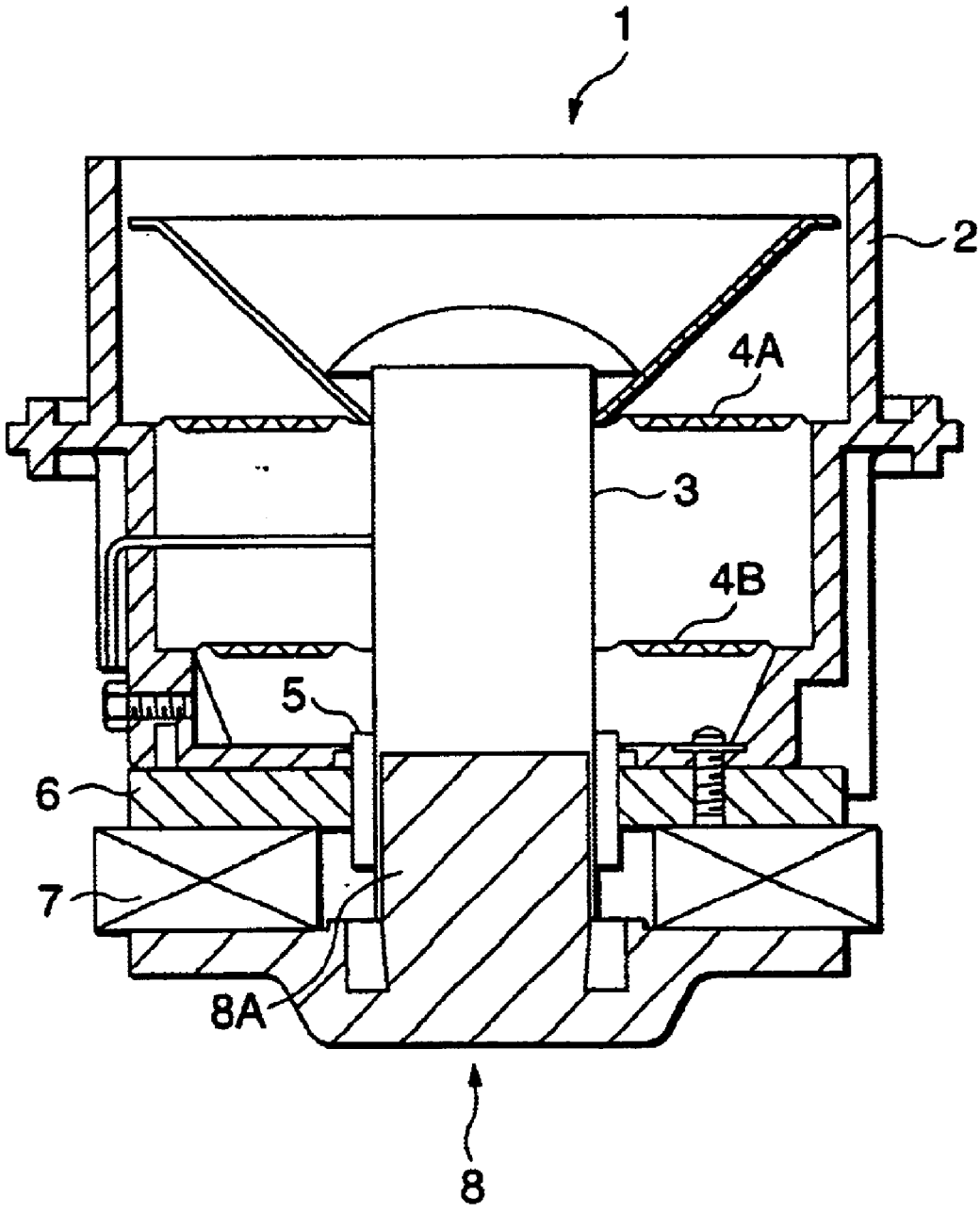
FIG. 5 is a cross sectional view showing a conventional speaker in which a voice coil bobbin is supported by a plurality of dampers.
Figure 6:
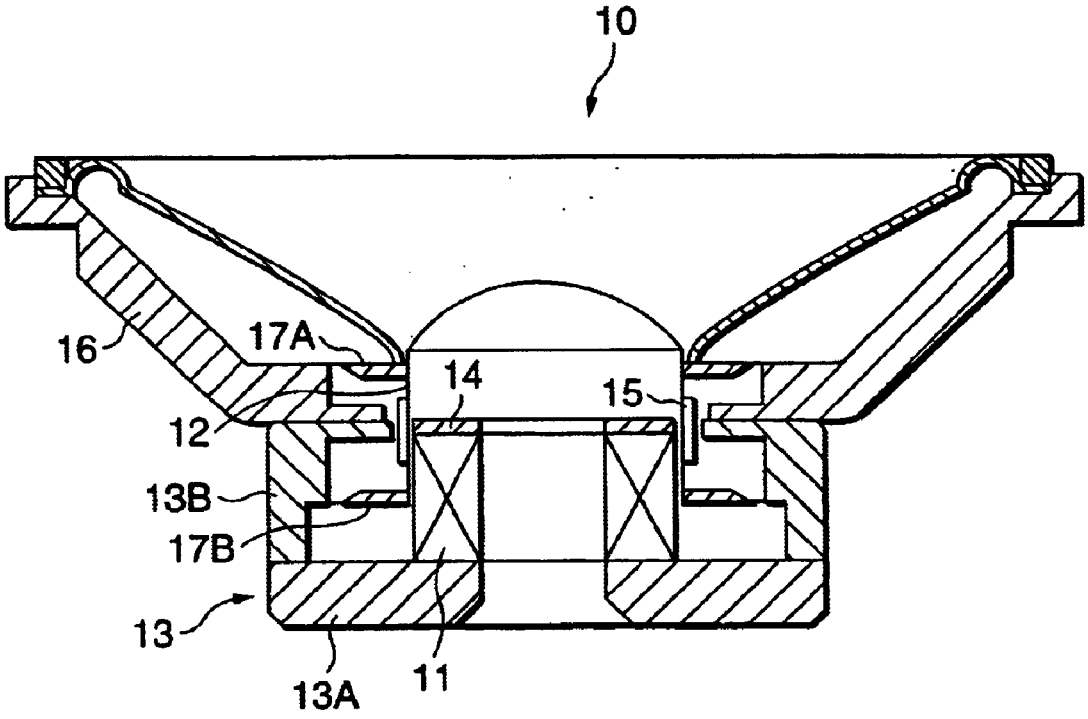
FIG. 6 is a cross sectional view showing another conventional speaker.

FIG. 4 is a cross sectional view showing a modification of the above-mentioned embodiment of the present invention. A speaker of FIG. 4 has a construction of the speaker 20 of FIG. 1, and further includes a ring-like magnet 40, a yoke 41, a voice coil 42, a cylindrical magnet 43, and a plate 44. The ring-like magnet 40 is disposed under the magnet 32 while the lower yoke 22 is interposed therebetween. The ring-like magnet 40 is opposite in polarity to the magnet 32. The yoke 41 is placed on the end surface of the ring-like magnet 40, which is opposite to its end surface on which the lower yoke 22 is placed. The voice coil 42 is put around the circumferential outer surface of the voice coil bobbin 25 at its location facing the yoke 41. The cylindrical magnet 43 is disposed within the voice coil bobbin 25 in a state that it faces the ring-like magnet 40 and is opposite in polarity to the latter. The plate 44 is placed on the end surface of the cylindrical magnet 43, which is opposite to its end surface on which the lower plate 31 is placed.

The remaining portions of the speaker of this embodiment is substantially the same as of the FIG. 1 speaker 20. Like or equivalent portions in the embodiment are designated by like reference numerals in FIG. 1. In the FIG. 4 speaker, another magnetic field is formed in a space between the yoke 41 and the plate 44, which includes the voice coil 42 located therebetween. A magnetic flux density of the magnetic field developed between the lower yoke 22 and lower plate 31 is increased by the ring-like magnet 40 and the cylindrical magnet 43. Therefore, when an acoustic signal current flows through those voice coils 28, 29 and 42, the voice coil bobbin 25 vibrates at increased amplitudes, thereby increasing the output power level of the speaker.

What is claimed is:

1. A speaker comprising:

a first magnet disposed at a mid position of a voice coil bobbin while surrounding the circumferential outer surface of said voice coil bobbin mounted on a vibrating plate;

a first voice coil wound on the circumferential outer surface of said voice coil bobbin at a position where said voice coil bobbin faces one end of said first magnet with a predetermined gap being interposed therebetween;

a second voice coil wound on the circumferential outer surface of said voice coil bobbin at a position where said voice coil bobbin faces the other end of said first magnet with a predetermined gap being interposed therebetween;

a center pole, disposed within said voice coil bobbin, for developing two magnetic fields in a state that said first and second voice coils are located between said one and other ends of said first magnet; and at least one couple of dampers for supporting said voice coil bobbin at positions such that said voice coil bobbin is axially vibratory, said positions being located on both sides of and symmetrical with respect to those portions of said voice coil bobbin which are respectively wound with said first and second voice coils, wherein a magnetic circuit is disposed completely inside a casing;

further comprising:

at least one third magnet disposed on the front or rear side of said first magnet; and at least one third voice coil wound on the circumferential outer surface of said voice coil bobbin at a location thereof facing the end of said third magnet which is opposite to the end thereof closer to said first magnet, said third voice coil facing the end of said third magnet which is opposite to the end thereof closer to said first magnet in a state that a predetermined gap is present therebetween.

2. A speaker comprising:

a first magnet disposed at a mid position of a voice coil bobbin while surrounding the circumferential outer surface of said voice coil bobbin mounted on a vibrating plate;

a first voice coil wound on the circumferential outer surface of said voice coil bobbin at a position where said voice coil bobbin faces one end of said first magnet with a predetermined gap being interposed therebetween;

a second voice coil wound on the circumferential outer surface of said voice coil bobbin at a position where said voice coil bobbin faces the other end of said first magnet with a predetermined gap being interposed therebetween;

a center pole, disposed within said voice coil bobbin, for developing two magnetic fields in a state that said first and second voice coils are located between said one and other ends of said first magnet; and at least one couple of dampers for supporting said voice coil bobbin at positions such that said voice coil bobbin is axially vibratory, said positions being located on both sides of and symmetrical with respect to those portions of said voice coil bobbin which are respectively wound with said first and second voice coils;

wherein the damper supporting the rear end of the voice coil bobbin is not limited in size by the size of the yoke, wherein an outer periphery of the dampers are attached to an inner surface of a casing for accommodating a magnetic circuit, and wherein the magnetic circuit is disposed completely inside the casing.

3. The speaker according to claim 2, wherein said center pole supports a second magnet arranged opposite in polarity to said first magnet.

4. The speaker according to claim 2, wherein said center pole is made of magnetic material.

5. The speaker according to claim 2, wherein said first and second voice coils are connected in series or parallel with each other.

6. The speaker according to claim 2, wherein wires enclosed by cotton electrically connecting said first and second voice coils are stitched into a least one of said dampers.

7. A speaker comprising:

a first magnet disposed at a mid position of a voice coil bobbin while surrounding the circumferential outer surface of said voice coil bobbin mounted on a vibrating plate;

a first voice coil wound on the circumferential outer surface of said voice coil bobbin at a position where said voice coil bobbin faces one end of said first magnet with a predetermined gap being interposed therebetween;

a second voice coil wound on the circumferential outer surface of said voice coil bobbin at a position where said voice coil bobbin faces the other end of said first magnet with a predetermined gap being interposed therebetween;

a center pole, disposed within said voice coil bobbin, for developing two magnetic fields in a state that said first and second voice coils are located between said one and other ends of said first magnet; and at least one couple of dampers for supporting said voice coil bobbin at positions such that said voice coil bobbin is axially vibratory, said positions being located on both sides of and symmetrical with respect to those portions of said voice coil bobbin which are respectively wound with said first and second voice coils;

wherein the damper supporting the rear end of the voice coil bobbin is not limited in size by the size of the yoke;

further comprising:

at least one third magnet disposed on the front or rear side of said first magnet; and at least one third voice coil wound on the circumferential outer surface of said voice coil bobbin at a location thereof facing the end of said third magnet which is opposite to the end thereof closer to said first magnet, said third voice coil facing the end of said third magnet which is opposite to the end thereof closer to said first magnet in a state that a predetermined gap is present therebetween.

* * * * *